United States Patent [19]

Stomp

[11] Patent Number: 4,526,353

[45] Date of Patent: Jul. 2, 1985

[54] SAFETY DEVICE FOR THE COVER OF A METALLURGICAL VESSEL

[76] Inventor: Hubert Stomp, 11 rue Speyer, L-2545 Howald, Luxembourg

[21] Appl. No.: 552,392

[22] Filed: Nov. 16, 1983

[30] Foreign Application Priority Data

Nov. 19, 1982 [LU] Luxembourg ..... 84481

[51] Int. Cl.[3] ..... C21C 5/00

[52] U.S. Cl. ..... 266/282; 266/287

[58] Field of Search ..... 266/287, 280, 275, 242, 266/282; 249/204; 432/262

[56] References Cited

U.S. PATENT DOCUMENTS

| | | | |
|---|---|---|---|
| 1,609,096 | 6/1926 | Smith | 432/262 |
| 1,997,988 | 4/1935 | Wever | 266/280 |
| 2,091,981 | 9/1937 | Hanson | 266/242 |
| 3,325,158 | 6/1967 | Ginder | 266/282 |

FOREIGN PATENT DOCUMENTS

| | | | |
|---|---|---|---|
| 0887984 | 7/1981 | Belgium . | |
| 2007341 | 9/1970 | France | 266/287 |

*Primary Examiner*—L. Dewayne Rutledge
*Assistant Examiner*—S. Kastler
*Attorney, Agent, or Firm*—Fishman & Dionne

[57] ABSTRACT

A safety device for protecting a cover used for closing a vessel in which molten metal undergoes metallurgical treatments is presented. The device is used in conjunction with the type of cover which rests on or hangs over the edge of the vessel. The device comprises a plurality of segments which preferably form a substantially cylindrical or funnel-shaped space. These segments may have any variety of configurations and/or shapes so long as they effectively eliminate the splashing and frothing of molten metal and slag.

29 Claims, 2 Drawing Figures

SAFETY DEVICE FOR THE COVER OF A METALLURGICAL VESSEL

BACKGROUND OF THE INVENTION

This invention relates to the field of metal refining. More particularly, this invention relates to a safety device for protecting the covers of vessels in which crude iron or molten steel undergo metallurgical processes or alloying operations.

During the conventional refining of iron into steel, crude iron or molten steel will typically undergo purifying treatments or alloying processes. Typical purifying processes include, for example, reducing the sulfur content of iron for specialty steels. It is well known that both the blast furnace and the oxygen top blowing converter offer only limited desulfurization capabilities. As a result, the production of certain grades of steel necessitate the desulfurization of the crude iron or steel to be conducted outside the blast furnace or converter. Moveover, in a large number of metallurgical processes, other substances, such as alloying elements have to be introduced into the liquid metal melt. Accordingly, special containers or vessels known as ladles are used in both the above mentioned purifying treatments and alloying processes.

Commonly, the metallurgical vessels or ladles are provided with covers during the above discussed refining treatments. The use of a cover is quite advantageous as it reduces any undesirable interaction between the metal bath and the atmosphere, thereby reducing possible reactions between the oxygen or nitrogen in the atmosphere with the metal melt. Often, a suction device for removing waste gases is mounted over the vessels or ladles. These suction devices will also aid in preventing any air which has entered the vessel from contacting the melt. The cover is also important in order to prevent the metal melt from escaping and splashing during the refining treatments.

The shape of the cover will be adapted to the particular configuration of the ladle which is being utilized. These large and heavy covers are usually deposited on the ladle by means of a chassis having a hoisting unit. A conventional cover is often provided with plural apertures having entrances for introducing blowing lances, probes or filling wires into the interior of the ladle. The apertures will also allow waste gases to escape in a controlled manner.

Unfortunately, certain problems and deficiencies have developed with conventional commercial ladle covers. For example, while the cover initially rests firmly on the upper surface of the ladle, over the course of time, the supposed tight fit will become extremely porous due, in part, to the highly corrosive nature of the splashing metal and frothy slag. This porosity results from gaps which develop between the casing of the ladle and the ring of the ladle cover. These porous gaps adversely affect the necessary and important separation between the metal bath and the atmosphere (which the cover is intended to effectively provide). Moreover, the difficult operation of removing the splashed and/or frothed hot impurities from the ring of the cover and from the edge of the ladle is complicated and dangerous.

One attempt to overcome the above discussed problems is disclosed in Belgian Pat. No. 887,984 wherein the vessels or ladles are provided wih a hood having an open ended pipe attached to the center thereof which catches the splashed melt before it can contact the hood. This funnel-shaped hood is connected to a suction system. The hood is positioned over the casing of the ladle such that an annular spacing is provided between the hood and the edge of the ladle or vessel. The lower portion of the pipe is comprised of a refractory material and can be immersed into the bath if so desired. The pipe covers 60–80% of the free surface of the melt. The upper portion of the pipe is attached to the hood via plural intermediate members.

The hood type cover as described in the British patent suffers from certain drawbacks. For example, since the tubular shaped pipe is subjected to considerable temperature differences, it will undergo relatively large expansions and contractions which will lead to metal deformation and consequently, shorter service life and higher labor and replacement costs. Unfortunately, even if only small portions of the pipe are damaged, the entire pipe must be removed and replaced. Finally, prior to replacing a damaged pipe, the hood and suction system will perform inadequately thereby adversely effecting deoxidation and promoting undesirable "nitrogen pick up" in the metal bath.

SUMMARY OF THE INVENTION

The above discussed and other problems of the prior art are overcome or alleviated by the novel safety cover of the present invention. In accordance with the present invention, a novel safety device for a cover is provided for metallurgical vessels or ladles. This safety device will permit the cover to rest tightly on the ladle casing over extended periods of time without developing undesirable gaps and dangerous leakage. The present invention thereby prevents outside atmospheric contact with the metal bath.

The safety device of the present invention is comprised of a plurality of segments which are positioned along the inner walls of a cover preferably forming a cylindrical or funnel-shaped space. The present invention offers many advantages and features over the prior art. Because the cover is essentially comprised of individual segments, expansions and deformation caused thereby will be minimized. Furthermore, the separate segments can be individually constructed and individually removable and replaceable, thereby achieving great cost savings. The cover of the present invention is also economically compatible with existing conventional covers of the type discussed in British Pat. No. 887,984. Finally, another feature of the present invention is increased durability relative to prior art cover devices.

The above discussed and other advantages of the present invention will be apparent to and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
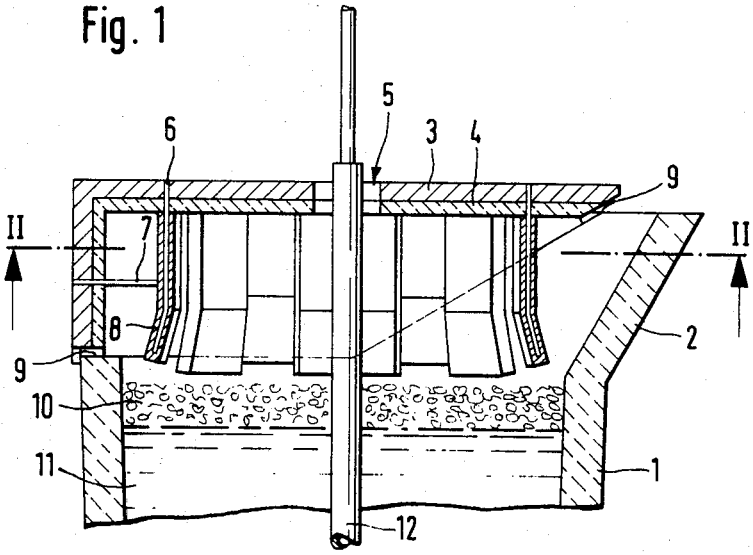
FIG. 1 is a cross sectional elevation view of the top portion of a ladle having a cover which incorporates the novel safety device thereon in accordance with the present invention.

Referring first to FIG. 1, a metallurgical vessel or ladle 1 provided with a pouring spout 2 is shown. A waste gas suction device (not shown) is mounted above the ladle 1 and is of the conventional type. The ladle contains a metal melt or bath 11 covered with a layer of slag 10. The metal cover 3 of the present invention is lined or at least partly lined with a refractory or fireproof material 4 and fits securely on supports 9. The cover is suspended above the upper edge of the ladle casing and overlays the entire bath 11 with the exception of the area around the spout 2. Within the cover 3 and attached thereon are a number of depending segments 8. With reference now to both FIGS. 1 and 2, preferably, the individual segments 8 are located or positioned around two concentric and discontinuous circles. Each segment 8 from a first circle will slightly overlap an adjacent segment 8 from a second circle. Similarly, each segment from a second circle will slightly overlap an adjacent segment from the first circle. The segments 8 are preferably made from a suitable metal material and also should preferably be provided with a fireproof or refractory coating at least partly or completely thereon.

Securing means are attached to the outside upper edge of each segment 8 so that the segments can be connected to the upper portion of the cover 3. The securing means may consist, for example, of metal bars partly cast to the segments and identified by reference numeral 6 in FIG. 1. The bars are provided at their free ends with screw threading. These bars then extend through corresponding apertures provided in the cover and are held therein by screwed nuts as shown in FIG. 1. In an alternative embodiment, the securing means comprises a plurality of eyes which extend from the segments 8. These eyes are secured on bars 7 having ends which are shaped accordingly. The other ends of the bars 7 pass through the cover 3 in the same manner as the bars of the first embodiment and are then subsequently secured into position by screwed nuts. In this embodiment, the bars 7 have been secured to the side portion of the cover 3. It has been found desirable to coat or at least partly coat the metal bars of the securing means with refractory or fireproof material. It has also been shown that when chains are used as a securing means, the chains have only lasted for a short period of time and therefore may not be useful or desirable.

An important feature of the present invention is the ability to adjust both the horizontal and vertical positioning of the segments 8. This adjustable feature permits the segments 8 to be inserted and adequately utilized in any conventional prior art ladle cover. Note that sufficient clearance must be provided between adjacent segments 8 in order to allow for slight expansions from the heat. In the embodiment shown in FIG. 1, the upper portion of the segments 8 rest or are seated against the cover 3. It should be understood that an intermediate space may alternatively be left between the segments 8 and the cover 3 if required in order to compensate for further expansions.

Obviously, any number of segment configurations which adequately satisfy the objects of the invention will be encompassed by the cover of the present invention. The particular configuration shown in the FIGURES having segments 8 comprised of two part rectangular members having a slot longitudinally therethrough defining a channel has been found to be advantageous and preferable. This channel acts to receive the above discussed receiving means. With reference to FIG. 1, the segments 8 shown therein have an upper portion which is rectangular and a lower portion having a trapezoidal configuration. Note that there is an angular bend at the transition point wherein the rectangular and the trapezoidal portions meet.

Alternatively, segments having a wholly trapezoidal shape may also be employed. Such trapezoidal segments would be inserted into the ladle cover and would form a funnel-shaped space. It has been found that the most economical configuration for these segments in accordance with the present invention is a flat rectangular shape, which, after being mounted within the cover, form a cylindrical space. As in the segments shown in the FIGURES, both the trapezoidal segments and rectangular segments may also have an interior slot longitudinally therethrough defining a channel for receiving securing means. It has been found that the segments 8 should cover at least 60% of the metal bath surface in order to be most effective and efficient.

Figure 2:
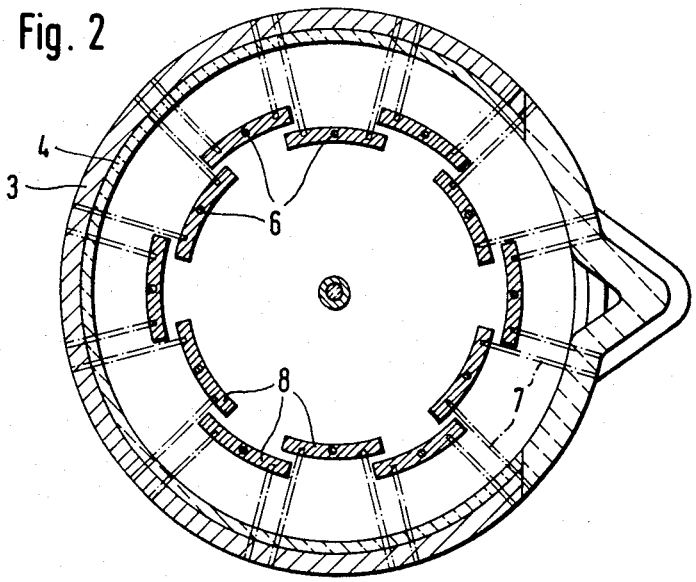
FIG. 2 is a cross sectional elevation view of the cover and safety device of FIG. 1 taken along line II—II.

The overlapping features of the segments of the present invention is provided in order to prevent slag, froth or metal melt from splashing between the segments. Note that the two longitudinal side portions of each segment may be positioned in front of or behind the corresponding longitudinal side portions of an adjacent segment as shown in FIG. 2. Of course, the segments 8 may equally be arranged in any desired configuration wherein the splashing of metal and slag is prevented thereby. For example, one longitudinal side portion of a particular segment 8 may be located in front of one adjacent segment while the other longitudinal side portion is located behind the other adjacent segment. The radial distance between two adjoining segments will, of course, be selected in order to enable the segments to expand freely. Finally, although the overlapping of segments is preferred, the segments 8 may also be arranged in a side by side non-overlapping fashion.

As mentioned previously, the novel cover with plural segments of the present invention offers many advantages and features over the prior art. The individual segments will prevent deformation caused by continuous expansions and contractions. Moreover, since the separate segments can be individually constructed and individually removed and replaced, the present invention affords increased cost savings and labor savings. Further cost effectiveness is derived from the fact that the present invention can be utilized and is compatible with existing conventional covers. Furthermore, the increased durability of the present invention will also significantly effect the improved cost effectiveness.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A safety device for protecting the cover of a metallurgical vessel having a metal bath therein, the cover resting on or hanging over the edge of the vessel, the cover having an upper portion and a side portion including:

a plurality of individually replaceable adjacent segments depending from within said cover, said adjacent segments overlapping each other whereby said metal bath is prevented from splashing against said vessel edge.

2. The device according to claim 1 wherein:
said segments form at least two concentric circles, said adjacent segments alternating between said concentric circles.

3. The device according to claim 1 including:
means to secure each of said segments to said cover.

4. The device according to claim 1 wherein:
each of said segments has a rectangular shape.

5. The device according to claim 1 including:
a layer of refractory material between said cover and said segments.

6. The device according to claim 1 wherein:
said segments are at least partly coated with a refractory material.

7. The device according to claim 1 wherein:
the area within the segments covers at least 60% of the metal bath surface.

8. The device according to claim 3 wherein:
said securing means connects each of said segments to the upper portion of said cover.

9. The device according to claim 3 wherein:
said securing means connects each of said segments to the side portion of said cover.

10. The device according to claim 3 wherein:
said securing means are at least partly coated with a refractory material.

11. The device according to claim 3 wherein:
said securing means are adjustable in length.

12. The device according to claim 4 including:
an interior slot longitudinally through each of said segments defining a channel capable of receiving said securing means.

13. A safety device for protecting the cover of a metallurgical vessel having a metal bath therein, the cover resting on or hanging over the edge of the vessel, the cover having an upper portion and a side portion including:
a plurality of individually replaceable adjacent segments depending from within said cover whereby said metal bath is prevented from splashing against said vessel edge, said segments forming at least two concentric circles, said adjacent segments alternating between said concentric circles.

14. The device according to claim 13 wherein:
the area between the segments covers at least 60% of the metal bath surface.

15. The device according to claim 13 including:
means to secure each of said segments to said cover.

16. A safety device for protecting the cover of a metallurgical vessel having a metal bath therein, the cover resting on or hanging over the edge of the vessel, the cover having an upper portion and a side portion including:
a plurality of individually replaceable adjacent segments depending from within said cover whereby said metal bath is prevented from splashing against said vessel edge; and wherein
each of said segments has a first section and a second section, said first section having a substantially rectangular shape and said second section having a trapezoidal shape.

17. The device according to claim 16 wherein:
the area between the segments covers at least 60% of the metal bath surface.

18. The device according to claim 16 including:
means to secure each of said segments to said cover.

19. The device according to claim 18 including:
an interior slot longitudinally through each of said segments defining a channel capable of receiving said securing means.

20. A safety device for protecting the cover of a metallurgical vessel having a metal bath therein, the cover resting on or hanging over the edge of the vessel, the cover having an upper portion and a side portion including:
a plurality of individually replaceable adjacent segments depending from within said cover, each of said segments having a trapezoidal shape whereby said metal bath is prvented from splashing against said vessel edge.

21. The device according to claim 20 wherein:
The area between the segments covers at least 60% of the metal bath surface.

22. The device according to claim 20 including:
means to secure each of said segments to said cover.

23. The device according to claim 22 including:
an interior slot longitudinally therethrough each of said segments defining a channel capable of receiving said securing means.

24. A safety device for protecting the cover of a metallurgical vessel having a metal bath therein, the cover resting on or hanging over the edge of the vessel, the cover having an upper portion and a side portion including:
a plurality of individually replaceable adjacent segments depending from within said cover, said segments forming a cylindrical space whereby said metal bath is prevented from splashing against said vessel edge.

25. The device according to claim 24 wherein:
The area between the segments covers at least 60% of the metal bath surface.

26. The device according to claim 24 including:
means to secure each of said segments to said cover.

27. A safety device for protecting the cover of a metallurgical vessel having a metal bath therein, the cover resting on or hanging over the edge of the vessel, the cover having an upper portion and a side portion including:
a plurality of individually replaceable adjacent segments depending from within said cover, said segments forming a funnel-shaped space whereby said metal bath is prevented from splashing against said vessel edge.

28. The device according to claim 27 wherein:
the area between the segments covers at least 60% of the metal bath surface.

29. The device according to claim 27 including:
means to secure each of said segments to said cover.

* * * * *